US008985368B2

(12) United States Patent
Knote et al.

(10) Patent No.: US 8,985,368 B2
(45) Date of Patent: Mar. 24, 2015

(54) AIR CARGO CONTAINER WITH A DEVICE FOR EXTINGUISHING FIRE

(75) Inventors: Andreas Knote, Braunschweig (DE); Ivonne Bartsch, Braunschweig (DE); Christian Huehne, Braunschweig (DE)

(73) Assignee: Deutsches Zentrum fuer Luft—und Raumfahrt e.V., Cologne (DE)

( * ) Notice: Subject to any disclaimer, the term of this patent is extended or adjusted under 35 U.S.C. 154(b) by 622 days.

(21) Appl. No.: 13/217,938

(22) Filed: Aug. 25, 2011

(65) Prior Publication Data

US 2012/0048852 A1 Mar. 1, 2012

(30) Foreign Application Priority Data

Aug. 30, 2010 (DE) ..... 10 2010 039 961

(51) Int. Cl.

| | |
|---|---|
| ***B65D 90/22*** | (2006.01) |
| ***A62C 3/00*** | (2006.01) |
| ***A62C 31/00*** | (2006.01) |
| *B65D 90/34* | (2006.01) |
| *B65D 88/14* | (2006.01) |

(52) U.S. Cl.

CPC . *B65D 90/22* (2013.01); *A62C 3/00* (2013.01); *A62C 31/00* (2013.01); *B65D 88/14* (2013.01)

USPC ..... 220/88.1; 220/9.2

(58) Field of Classification Search

USPC ..... 220/88.1

See application file for complete search history.

(56) References Cited

U.S. PATENT DOCUMENTS

| | | | | |
|---|---|---|---|---|
| 2,404,418 | A * | 7/1946 | Walker | 220/88.1 |
| 4,036,361 | A | 7/1977 | Jacobson et al. | |
| 5,842,524 | A * | 12/1998 | Farmer | 169/45 |
| 7,506,478 | B2 | 3/2009 | Bobenhausen | |

FOREIGN PATENT DOCUMENTS

| | | |
|---|---|---|
| DE | OS 1 786 205 | 1/1972 |
| DE | 26 56 639 A1 | 6/1977 |
| DE | 103 18 975 B3 | 12/2004 |
| DE | 103 58 978 A1 | 8/2005 |
| DE | 1 306 312 B1 | 12/2006 |
| DE | 10 2009 046 409 A1 | 5/2011 |
| EP | 1 655 058 A1 | 5/2006 |

OTHER PUBLICATIONS

European Search Report in copending, related European application No. 11178904.6, mailed Nov. 24, 2011.

* cited by examiner

*Primary Examiner* — Jacob K Ackun
*Assistant Examiner* — Niki Eloshway
(74) *Attorney, Agent, or Firm* — Thomas | Horstemeyer, LLC

(57) ABSTRACT

The invention relates to an air cargo container with an interior space limited by a wall and sealed against the exterior for avoiding an entry of fluid. The wall comprises a first operating configuration wherein said interior space limited by the wall has a first volume $V_{I1}$. Furthermore, in case of a fire the wall is deformed into a second operating configuration wherein said interior space limited by the wall comprises a second volume $V_{I2}$ being smaller than the first volume $V_{I1}$. A check valve blocks fluid from streaming from the exterior into the interior space but opens for a stream from the interior space to the exterior. An actuation means for changing the operating configuration in case of a fire automatically transfers the wall from the first operating configuration into the second operating configuration. During this transfer fluid is pushed from said interior space via the check valve to the exterior.

12 Claims, 5 Drawing Sheets

AIR CARGO CONTAINER WITH A DEVICE FOR EXTINGUISHING FIRE

CROSS REFERENCE TO RELATED APPLICATIONS

This application claims priority to co-pending German Patent Application No. DE 10 2010 039 961.2 entitled "Container mit Feuerloscheinrichtung", filed Aug. 30, 2010.

FIELD OF THE INVENTION

The present invention generally relates to a cargo container, in particular an air cargo container used for housing, storing and/or transporting an air cargo. The cargo container might be used for any cargo, e.g. items and/or liquids.

BACKGROUND OF THE INVENTION

A fire in the interior space of an air cargo container and/or the air cargo container itself causes material damages due to the fact that the content of the air cargo container might become useless. Furthermore, there is the danger that a fire of or in an air cargo container might have negative effects on the neighborhood of the air cargo container. The fire might expand or build a source of heat causing additional damages. Finally, the fire might cause damages due to smoke or might threaten the health of persons in the neighborhood of the air cargo container.

As an order of the Spanish air force the company VRR Air Cargo Equipment developed an air cargo container with an interior space limited by a rigid metallic housing. Fire extinguishers were fixed at the housing for injecting an extinguishing agent into the container in case of a fire (see http://www.vrr-aviation.com/products/military/aay-container-fire-containment-container-(fcc)).

German patent application DE-OS 1 786 205 discloses an air cargo container built by a plane bottom plate and a flexible wall which is pumped up similar to an air cushion or air bed. The wall builds a thermic isolation. In an unloaded operation configuration of the air cargo container the wall is folded for occupying a reduced space only slightly exceeding the volume of the bottom plate. In case that the air cargo container is to be loaded, the walls are built up by inflating the walls similar to air beds with a pressurized gas. The container might comprise an opening for loading and unloading. The opening is closed by a closing element with a zip fastening. An upper or sealing curvature of the wall might be adapted to the curvature of the storage space of the airplane. The bottom plate might comprise mounting devices for anchoring the bottom plate with the storage space of the airplane. Further supporting devices (as a support in the shape of a metal or plastic tube inserted between the bottom plate and the sealing wall, in particular located close to the opening for loading and unloading) might also be provided. The document suggests using a wall being impermeable for gas, e.g. a wall made of a rubber fabric. The wall might have tube-like sections that can be filled with a gas. The document also suggests filling these tubes with nitrogen for extinguishing a fire.

German patent application DE 26 56 639 A1 discloses a foldable container for a liquid or solid cargo. The container is built with a tube-like or bag-like wall spanned by a flexible, foldable or telescopable support structure between a bottom plate and a cover plate. The document suggests choosing a support structure having a high resistance against fire and high temperatures or having self-extinguishing properties in case of a fire.

German patent DE 103 18 975 B3 (see U.S. Pat. No. 7,506,478 B2) discloses a method for extinguishing a fire in a closed space of an airplane, in particular in an overhead bin in a passenger compartment or in a container in the cargo compartment of an airplane. Generally, a space protected against the build-up of a fire should be sealed so that the amount of oxygen for the fire is limited. Undesired leakages of these spaces lead to the disadvantage that the fire is supplied with additional oxygen. On the other hand, smoke might leak into the neighbouring spaces. The patent suggests locating a material close to an expected leaking area which foams and changes its volume when heated. In case of a fire building up the material foams and automatically seals the undesired leakage. Accordingly, the supply of oxygen via the leakage is reduced or terminated.

German patent application DE 103 58 978 A1 discloses a fire protection element having a compact configuration for storage. In case of a fire the fire protection element is thrown over the fire where the fire protection element automatically unfolds from the compact configuration to an extended configuration for building a fire blanket. Such an automatically expanding fire blanket is proposed for use in case of a fire in a domestic home, in buildings, vehicles, in the forest, in chemistry, for burning oil, burning electronic components and for smoldering fires. The patent application suggests equipping the fire protection element with an expander. The expansion of the expander is triggered by a trigger. The trigger might be activated manually when throwing the fire protection element, with the impact of the fire protection element with the burning material, by radio frequency or wirelessly or by a sensor sensing a temperature, smoke or radiation. The energy of the expander might be stored as an elastic pretension, a pressure of a pyrotechnic gas generator, a gas cartridge, the energy of the throw or an archimetric lifting force. For applications with fire classes A, B and C the document suggests to wet the fire blanket already in the storage configuration, equip the fire blanket with internal water bags or wet the fire blanket immediately before its use. It is also possible to manufacture the fire blanket from a non-conducting electric material as ceramics or plastic. Furthermore it is possible to use a surface coating for influencing the radiation. Additional to the automatically triggered expansion by the cooperation of the trigger with the expander the deformable fire blanket might automatically adapt to the contour of the burning materials due to its weight. It is possible that the expander due to the high temperature or also automatically loses its stiffness after the expansion. However, it is also possible that the expander is stiffened after being unfolded such that the fire blanket might build a self-supporting wall for blocking or redirecting the flame front, limiting a fire or enclosing an object to be protected. In order to remove oxygen from a fire in closed spaces, the patent application also suggests using an expanding fire protection element with an interior space. With the expansion the volume of the interior space increases. Air or oxygen is drawn into the interior space for reducing the free air or oxygen available for the fire.

OBJECT OF THE INVENTION

It is an object of the present invention to provide an air cargo container with alternative or improved options for fighting a fire in an interior space of the air cargo container. It is another object of the invention to provide an air cargo container with a simple design or configuration. For still another object of the invention an air cargo container is suggested which is manufactured with low costs. On the other hand, it is an object of the invention to provide an air cargo container with a high efficiency of fighting a fire. Another optional object of the invention might be to provide an air cargo container which might have a reduced or flexible volume for loading, unloading and its transportation and storage.

SUMMARY OF THE INVENTION

The present invention bases on the finding that the build-up and the maintenance of a fire in an cargo container requires both a liquid or solid flammable material as well as oxygen in any form. The inflammable material might be provided by the cargo container itself which might be excluded by an appropriate material choice. Furthermore, the flammable material might be built by the goods stored within the cargo container. The oxygen is in general supplied by an item or liquid housed within the cargo container but preferably by the oxygen of the air located in the interior space.

According to DE 103 18 975 B3, the supply of oxygen through a leakage area of the container is interrupted for extinguishing the fire after the oxygen in the interior space of the container has been burned. Accordingly, this patent accepts a minimum amount of oxygen and fire which is dependent on the velocity of closing a leaking area and on the amount of oxygen or air contained in the container. In case that for this prior art the container is completely filled with the cargo, there is only a small amount of oxygen inside the interior space. This small amount of oxygen is burned by a small fire after a short time. However, in case that the container is only partially filled with the cargo the oxygen contained within the interior space lasts for the build-up of a larger fire.

Basing on the above findings, the invention leaves the established route of the person with skill in the art of accepting that a volume of air or oxygen located in the interior space of the container is a given fixed volume. This given fixed volume would correlate with the potential of an undesired fire.

The invention suggests a cargo container having an interior space limited by a wall. The interior space is sealed against the entry of air into the interior space. For the inventive cargo container the volume of the interior space is not constant. Instead, the wall limiting the interior space comprises a first operating configuration and a second operating configuration:

The first operating configuration corresponds to the normal configuration of the container without a fire. In the first operating configuration the interior space limited by the wall has a volume $V_{I1}$. In case that a cargo, in particular items or goods, are located in the interior space having a volume $V_G$, a residual volume of a fluid as air $V_{F1}$ remains in the interior space, wherein $V_{F1}=V_{I1}-V_g$ holds.

Instead, in the second operating configuration the wall reduces the volume of the interior space limited by the wall from the volume $V_{I1}$ in the first operating configuration to a volume $V_{I2}<V_{I1}$. Under the assumption of an unchanged volume $V_G$ in the interior space a reduced fluidic or air volume $V_{F2}$ remains (, wherein $V_{F2}=V_{I2}-V_g$). A consequence of this reduction is that in the second operating configuration there is only a reduced volume $V_{F2}<V_{F1}$ of air or oxygen for building up a fire. The indices used above are as follows: The first index "I" stands for "interior space" whereas the index "F" stands for "fluid" (so in particular air) whereas the second index "1" represents the first operating configuration (so the normal case without a fire) and the second index "2" denotes the second operating configuration (so an existing fire).

There are a lot of different options for providing an automatic change from the first operating configuration to the second operating configuration:

According to the invention, a check valve is provided. The check valve is integrated into the container for blocking the stream of air or a fluid from the exterior to the interior space of the cargo container. The check valve opens for a stream of air or fluid from the interior space to the exterior of the cargo container.

The inventive cargo container comprises an actuation means for changing the operating configuration. In case of a fire this actuation means automatically transfers the wall from the first operating configuration into the second operating configuration, so reduces the fluid or air volume from $V_{F1}$ to $V_{F2}$. This reduction is done by transferring fluid or air with a difference volume $V_D=V_{F1}-V_{F2}$ from the interior space via the check valve to the exterior.

According to the invention, by the reduction of the fluid or air supporting a fire the build-up of the fire in the interior space of the cargo container is stopped, reduced or delayed. The inventive measures might also be taken without the use of an additional extinguishing agent that might reduce the value of the items stored in the container or might lead to the result that the cargo container is not reusable. (However, it is also possible that additional to the inventive measures also an extinguishing agent or other measures explained for the background art are taken.)

For one embodiment of the invention the second operating configuration of the wall is automatically taken in case that a fire builds up in the cargo container or exceeds a limit size or limit duration.

The change of the wall from the first operating configuration into the second operating configuration might be triggered or caused by the actuation means in a lot of different ways. To name only one possible example, the means for changing the operating configuration might comprise a sensor for detecting a fire that might be based on a smoke detection or a thermic sensor, might comprise an actuator that is automatically activated in case of the detection of a fire by the aforementioned sensor and a wall moved or folded or deformed for a reduction of the volume of the interior space.

For another embodiment of the invention the wall limiting the interior space is built by a flexible wall material which is not rigid. A deformation of the flexible non-rigid material provides the change from the first operating configuration of the wall to the second operating configuration of the wall. For this configuration a holding device is used. The holding device normally holds the wall in the first operating configuration. This might be done in a plurality of different ways. To name only some examples, the container might comprise a kind of supporting frame work or scaffolding or an outer housing holding the flexible wall in the first operating configuration. The wall might be held at the framework or scaffolding by adhesive bond, sewing, stitching, tacking or in any other way. Furthermore, it is possible that the wall is held by holding devices built by clamping or spanning devices or unfolding devices, in particular of the type of tent poles in the first operating configuration.

In case of a fire the actuation means might remove or at least reduce the holding effect of the holding device. This allows the flexible wall to move into the second operating configuration.

There are also a lot of different options for removing or at least reducing the holding effect of the holding device. To name only some examples, the holding effect of the holding device might be removed or reduced by an actuator triggered by a sensor detecting a fire. For another embodiment the holding device looses its holding effect due to upcoming smoke or heat, in particular by a reduction of an adhesive force due to smoke or heat or by influencing the spanning or clamping or unfolding device by the heat of smoke.

The energy for causing a change of the operating configuration from the first operating configuration into the second operating configuration might be taken from any energy source and might be applied by any actuator or mechanism.

For one embodiment of the invention, the means for changing the operating configuration is an elastic deformation element at least partially providing the energy for a change of the operating configuration. An elastic pretension of the deformation element is larger for the wall being in the first operating configuration than in the second operating configuration. Via a relaxation of the elastic deformation element the wall is transferred from the first operating configuration into the second operating configuration. Accordingly, the elastic deformation element is also (at least partially) responsible for "pushing" the fluid or air located in the interior space through the check valve to the exterior. The elastic deformation element might be any discrete or continuous deformation element, e.g. a spring element. The elastic deformation element might be always effective wherein a relaxation of the elastic deformation element from the first operating configuration is blocked by the holding device but triggered with a reduction or removal of the holding effect of the holding device.

For a special embodiment of the invention, the pretension of the elastic deformation element only comes into play in case that a fire builds up. To name only one example of the variety of possibilities, a thermoplastic deformation element might be used with frozen strains or stresses wherein the strains or stresses are only freed in case that the temperature in the interior space of the cargo container exceeds a threshold value.

For an alternative or cumulative embodiment the transfer of the wall from the first operating configuration into the second operating configuration might be at least partially caused by the weight of the wall so that the weight is also responsible for pushing the fluid or air through the check valve. To name one example, the flexible wall might be held in the first operating configuration with a certain distance from the bottom of the cargo container and the cargo located in the cargo container. For achieving the second operating configuration the flexible wall material falls, sinks or folds from the first operating configuration down to the bottom plate of the cargo container and the cargo (which might be compared to the effect of a fire blanket). The weight of the wall material effects that the wall closely adapts to the burning cargo and only a small amount or no air or oxygen remains between the wall and the cargo because the air or the oxygen has been removed from the interior space via the check valve. The person with ordinary skill in the art will understand that the movement of the wall material might be supported by additional weights or masses.

In general, the present invention might be used for any design of the housing, the wall and/or the bottom of the cargo container. E.g. a fire resistant pallet as described in EP 1 306 312 B1 might be used as a bottom plate. Also the construction of the container according to the documents acknowledged above might be used. For one embodiment of the invention, the interior space is limited by a tent-like plane or tarpaulin building the wall. The tarpaulin is spanned by rods, e.g. tent poles, building the holding device for the first operating configuration. This builds a simple and economic design. Furthermore, this embodiment provides the option of a transportation of the container with a reduced volume. For this design additional measures for building a tent-like cargo container can be taken from patent application DE 10 2009 046 409 A1 of the applicants.

The invention also suggests using a material for the wall which is not inflammable or has a low flammability. The use of a textile material or a polymeric material with a low flammability is also suggested.

It is possible that the cargo container has been manufactured and distributed with the above specified features. However, according to another suggestion of the invention an add-on kit might be used for rebuilding a common container to an inventive cargo container. The add-on kit comprises a wall of a flexible, non-rigid material for limiting an interior space of the common container. Furthermore, the add-on kit comprises a check valve for transferring fluid from the interior space limited by the flexible wall to the exterior of the wall, so into an intermediate space of the housing of the common container and the flexible wall and/or to the exterior of the housing of the common container. Furthermore, the add-on kit comprises a actuation means for changing the operating configuration as describes above.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
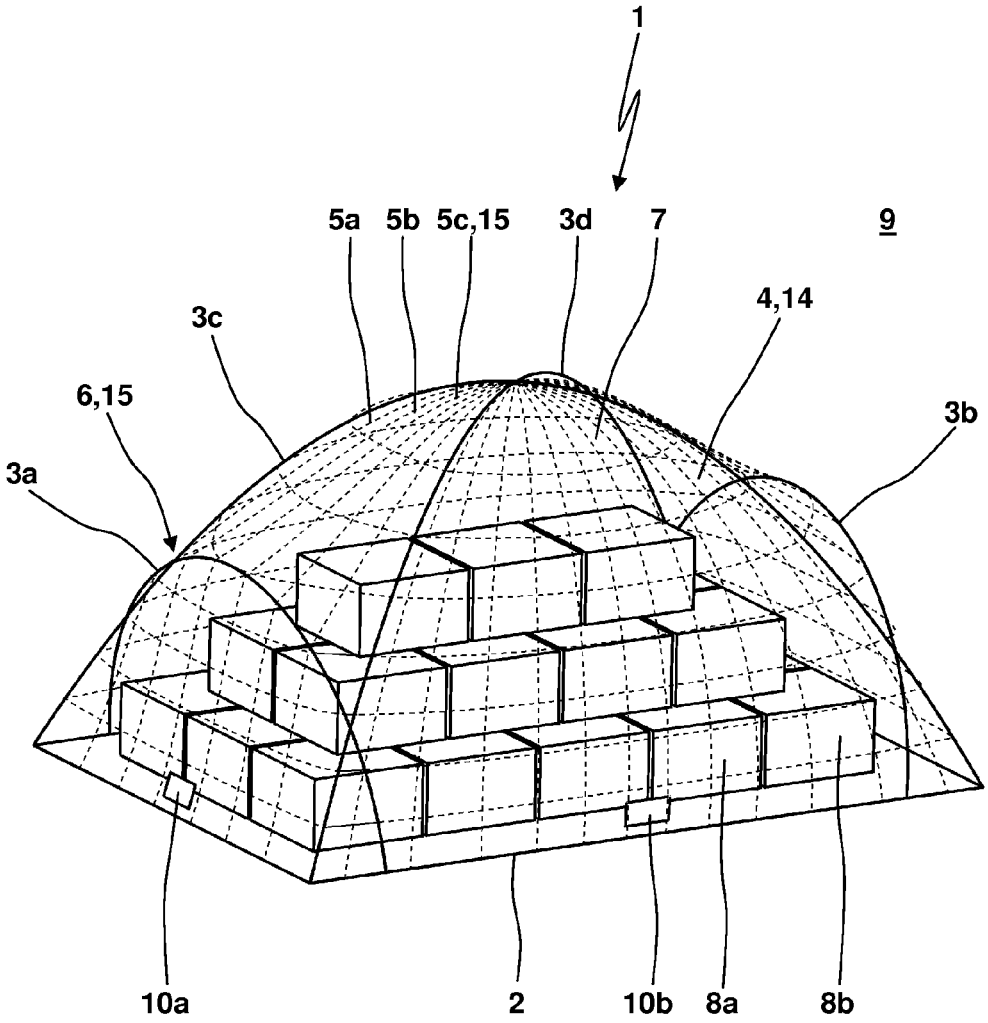
FIG. 1 is a three-dimensional schematic view of an inventive air cargo container with cargo located in the interior space, wherein the air cargo container is in the first operating configuration.

FIG. 1 schematically shows a container 1 in a three-dimensional view. The container 1 comprises a bottom plate 2 which is rectangular for the shown embodiment. Rods or tent poles 3*a* to 3*d* are supported at the bottom plate. The tent poles 3*a* to 3*d* are bent with a pretension, strain or stress. The tent poles 3 span a tarpaulin or cover 4 similar to a tent. The tarpaulins 3 are passed through eyes, loops, lugs, pull straps or folds of the tarpaulin 4 or linked with the same by other means. The tarpaulin 4 is not or only to a small degree permeable for air and connected and sealed with the bottom plate 2. The tarpaulin 4 comprises closable openings that are not shown in FIG. 1, wherein a sealed closing element might be linked with the tarpaulin 4 with a zip fastener. Deformation elements 5, constriction elements or spring elements are integrally built by the tarpaulin 4 or integrated into the same or coupled with the same. For the shown embodiment the deformation elements 5*a*, 5*b*, 5*c* are integrated into the tarpaulin 4. The deformation elements 5*a*, 5*b*, 5*c* extend like sent out rays from the highest point and the crossing point of the tent poles 3*c*, 3*d*. Other deformation elements have an orientation in circumferential direction or equatorial direction. The deformation elements 5 with the extension as sent out rays extend from the margin or edge of the bottom plate 2 (and of the tarpaulin 4) to an opposite edge or margin of the bottom plate 2 (and of the tarpaulin 4). A holding device 6 is built with the tent poles 3. The holding device 6 holds the container 1 in the first operating configuration shown in FIG. 1. In the first operating configuration an interior space 4 is built between the tarpaulin 4 and the bottom plate 2. In the interior space 7 goods, items or cargo 8 is located. The cargo 8 might (differing from FIG. 1) also be built by a liquid.

The interior space 7 in the first operating configuration has a volume $V_{I1}$. The cargo 8 has a volume $V_G$. Between the tarpaulin 4, the bottom plate 2 and the cargo 8 a volume is built which is filled with a fluid, in particular air, having a fluid volume $V_{F1}$. Between the interior space 7 and the exterior 9 check valves 10*a*, 10*b* are located. For the shown embodiment the check valves 10*a*, 10*b* are integrated into the tarpaulin 4. Furthermore, it is possible that check valves 10 are integrated into the bottom plate 2. The check valves 10 block a stream of air from the exterior 9 into the interior space 7, whereas the check valves 10 open for a stream of air or another fluid from the interior space 7 to the exterior 9.

Figure 2:
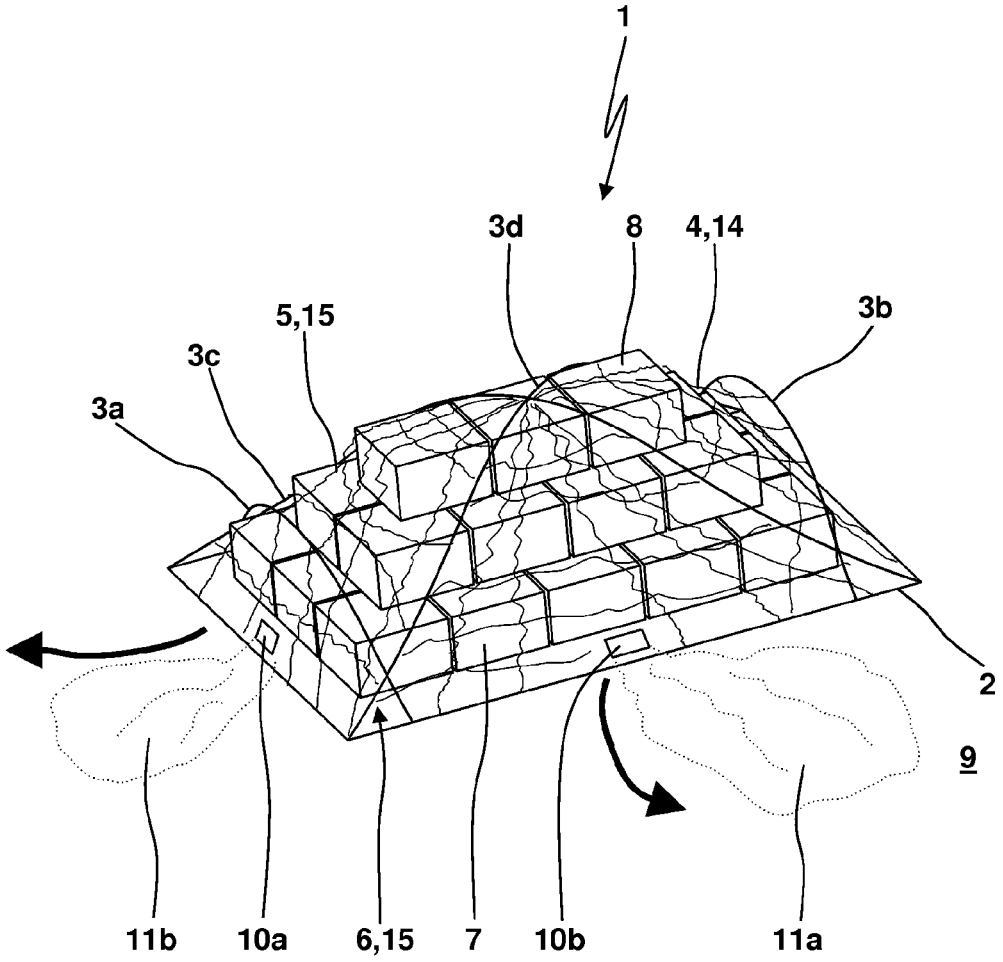
FIG. 2 is the container of FIG. 1 in the second operating configuration.

FIG. 2 shows the container 1 in the second operating configuration. In the second operating configuration the holding effect of the holding device 6 is removed or decreased. Here, the tent poles 3 no longer hold the tarpaulin 4 in the spanned state as shown in FIG. 1. Instead, the tarpaulin 4 has fallen down towards the bottom plate 2 and the cargo 8 and has come into contact with the tarpaulin. In the extreme case that the tarpaulin 4 completely adapts to the bottom plate 2 ant cargo 8 the volume $V_{I2}$ of the interior space 7 in the second operating configuration corresponds to the volume of the cargo 8 $V_G$. In praxis in some cases a residuing fluid volume $V_{F2}$ remains between the tarpaulin 4 and the cargo 8 and the bottom plate 2, wherein $V_{I2}=V_G+V_{F2}$ holds. The difference fluid volume 11 $V_D$ is transferred from the interior of the container 1 with the change from the first operating configuration to the second operating configuration via the check valves 10 to the exterior 9. For the difference volume $V_D$ streaming through the check valves 10 $V_D=V_{I1}-V_{I2}$ holds. It is also possible that in case of a fire in the container 1 the holding effect of the holding device 6 is automatically removed. In particular, the tent poles 3 reduce or loose their bending stiffness due to an increase of the temperature or due to smoke. It is also possible that the deformation elements 5 have a pretension in the first operating configuration according to FIG. 1, wherein the pretension is responsible for the movement of the tarpaulin 4 in downward direction and for the establishment of the contact forces of the tarpaulin 4 with the bottom plate 2 and the cargo 8. For an alternative or cumulative embodiment, the tarpaulin 4 might move in downward direction due to its weight or possible additional masses or weights. It is also possible that the tent poles 3 and/or the deformation elements 5 are built with a shape memory material. Furthermore, it is possible that strains or stresses are frozen in the material. With upcoming smoke or an excess of a threshold value of the temperature the deformation elements 5 and/or the tent poles 3 tend to a shape according to the second operating configuration shown in FIG. 2.

With the transfer to the second operating configuration the amount of oxygen in the interior space 7 is reduced which correlates with the volume of the transferred fluid $V_D$. This leads to the effect that the fire is extinguished.

Figure 3:
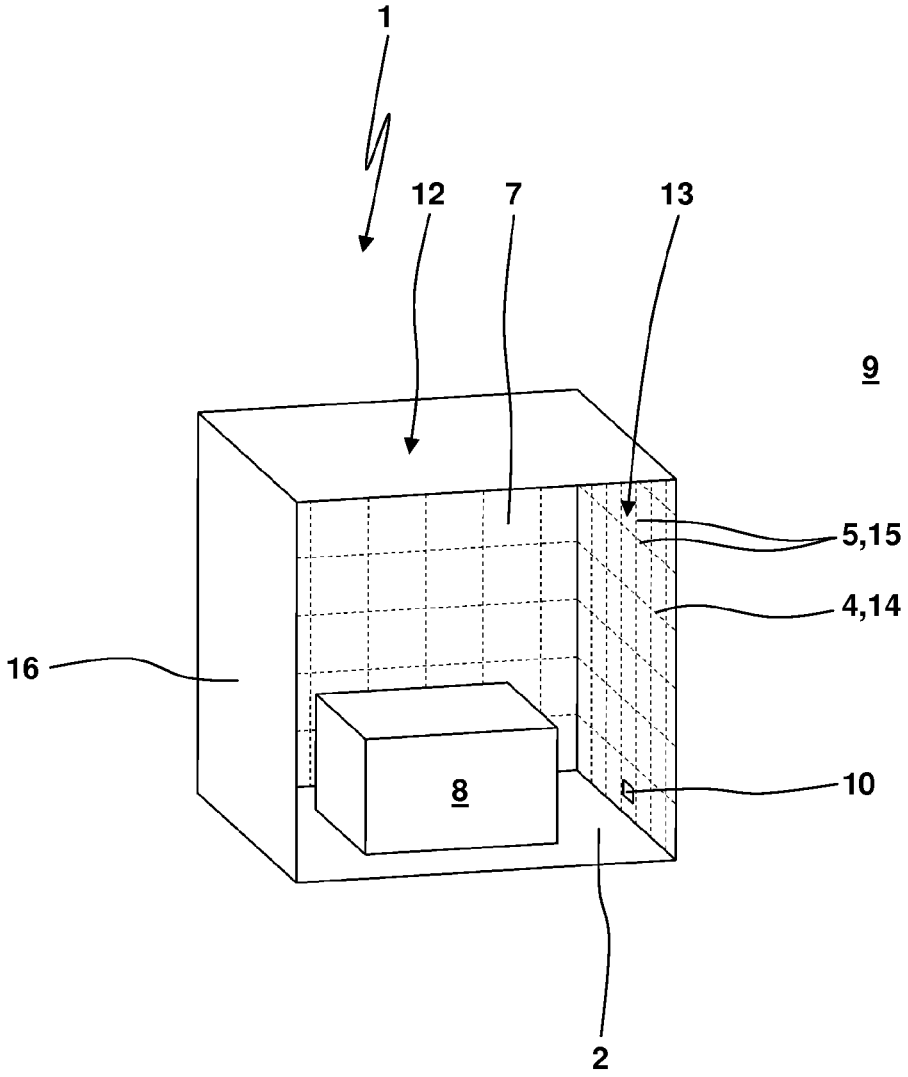
FIG. 3 shows schematically a common container without a front wall which has been rebuilt with the add-on kit to an inventive air cargo container, wherein the air cargo container is in the first operating configuration.
Figure 4:
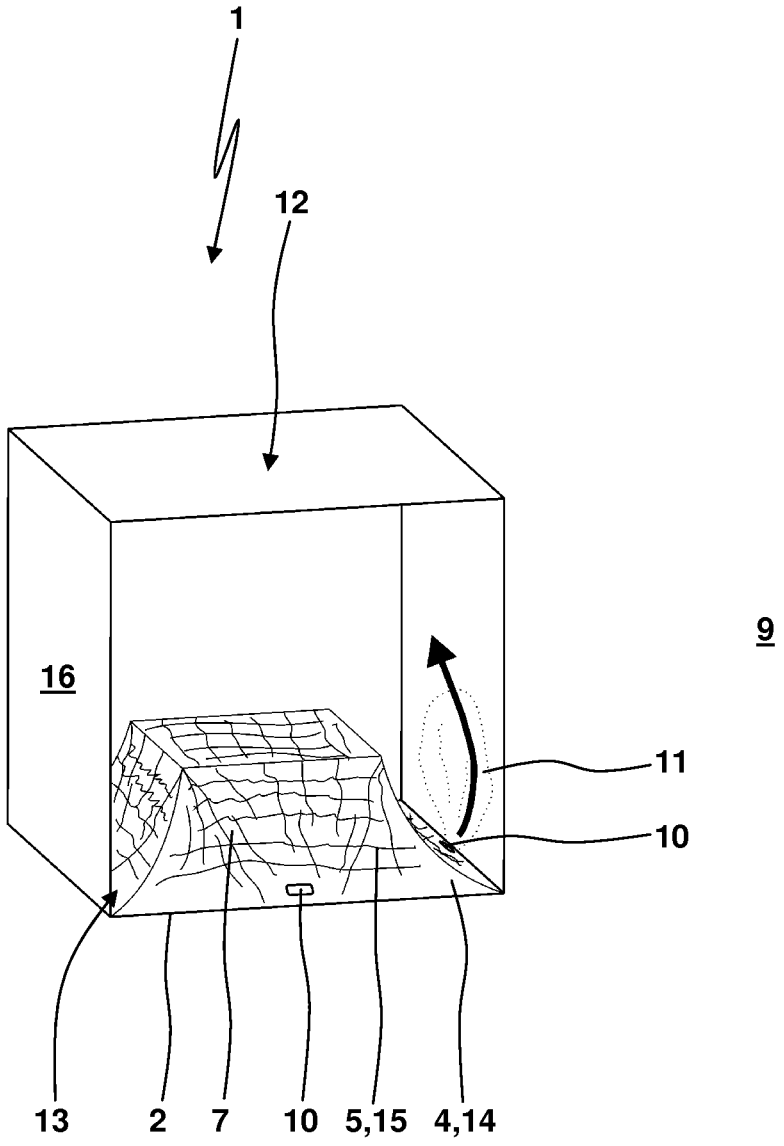
FIG. 4 shows the rebuilt container according to FIG. 3 in the second operating configuration.

FIG. 3 shows a common rigid container 12 which per se is not fluidly sealed. The container 12 might have openings not shown in FIG. 3. The container 12 comprises a bottom plate 2. The container 12 is lined or backed with the tarpaulin 4. For the shown embodiment the tarpaulin 4 is impermeable for air connected with the impermeable bottom plate 2 which might be done by an adhesive. In case that the bottom plate 2 of the common container 12 is not impermeable for air the tarpaulin 4 might also extend over the bottom plate 2. For the shown embodiment the holding device 6 is built by fixing the tarpaulin 4 at the rigid wall of the container 12, e.g. by adhering, tying, clipsing, hook-and-pile fasteners. It is also possible that the tarpaulin is suspended at the rigid wall of the container 12. The interior space 7 houses the cargo 8. For the shown embodiment, the deformation elements 5 are grid-like or meshed and integrated into the tarpaulin 4. The tarpaulin 4 also comprises at least one check valve 10. An add-on kit 13 is built with the tarpaulin 4, the check valve 10 and the holding device linked with the tarpaulin 4 and the wall of the container. The add-on kit 13 is used for rebuilding a common container 12 to an inventive air cargo container. FIG. 3 shows the container 12 with the add-on kit 13 in the first operating configuration. In case of a fire in the interior space 7, the add-on kit 13 automatically is transferred to the second operating configuration as shown in FIG. 4. The tarpaulin 4 sinks, falls, folds or moves from above to the cargo 8 and the bottom plate 2. With this movement the fluidic volume $V_D$ is transferred via the check valve 10 to the exterior 9. In a special embodiment also the common container 12 is impermeable for air so that the fluidic volume $V_D$ is only transferred from the interior space into the interior of the container 12 but not to the exterior of the container 12. The tarpaulin 4 shown in the figures is only one example for a flexible non-rigid wall 14 that might be used for the present invention. The means 15 for changing the operating configuration used for the transfer from the first operating configuration into the second operating configuration or for removing the holding effect of the holding device might be built by at least one tent pole 3 which loses its rigidity, stiffness, strength or bending stiffness. It is also possible that the tent poles 3 with a threshold of the temperature change their shapes. It is also possible that with the threshold temperature strains or stresses are freed. For a cumulative or alternative embodiment the means 15 for changing the operating configuration might also be a deformation element 5, e.g. elastic spring elements, threads or constriction elements that are biased by a pretension in the first operating configuration. It is also possible that the deformation elements only built up a pretension in case that a fire builds up in the interior space 7 of the container 1.

Figure 5:
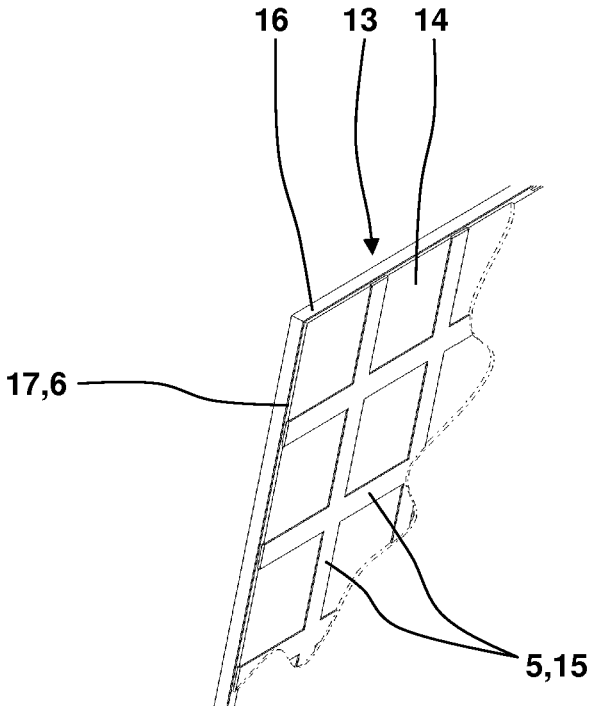
FIG. 5 shows a sectional view of a wall of a rebuilt container according to FIGS. 3 and 4.

FIG. 5 shows a partial sectional view of the container 1 in the first operating configuration according to FIG. 3 wherein the container 1 is equipped with the add-on kit 13. Wall 16 of the common container 12 is linked with wall 14 being part of the add-on kit 13 by an adhesive layer 17. Wall 14 comprises cross-like extending deformation elements 5. For the shown embodiment the deformation elements 5 are threads or straps of a thermoplastic material with frozen strains or stresses. The cross-like configuration of the deformation elements 5 might have the effect that the flexible wall in the second operating configuration closely fits any contour built by the cargo. Stresses activated with the heating in the threads or straps of the thermoplastic material have an amount sufficient for overcoming the adhesive force of the adhesive layer 17. It is also possible that with an increase of the temperature in the interior space 7 with an upcoming fire the adhesive force of the adhesive layer 17 is reduced.

The deformation elements 5 might be thermoplastic elements stretched during the manufacturing process and cooled down in stretched state. These thermoplastic materials have the capacity to remove into their unstretched starting state when heated. Shrinkage relations of more than 3:1, 5:1, 8:1 or 10:1 are possible. The threshold value for the temperature triggering the shrinkage process might depend on the material configuration and might be between 65° and 125°, e.g. between 80° and 110° or might lie above 90° (however, in other cases the threshold value for the temperature might also be higher or lower).

Besides a design of the container as described above, the invention might also be applied for air cargo containers as described in the non-published patent application DE 10 2009 046 409.3.

It is possible that a supporting structure built with the tent poles 3 is made of a thermoplastic material with frozen stresses or strains as described above. These supporting structures might be manufactured in a simple manufacturing process by extrusion which is also the manufacturing process for stretched thermoplastic materials. For the tarpaulin 4 or any other wall 14 a textile or polymeric material might be used. It is possible that (as shown in FIG. 1) deformation elements 5 extend from the highest point of the container as sent out rays or in equatorial direction, so in circumferential direction of the container 1. These deformation elements 5 might be made of stretched thermoplastic material. The deformation elements 5 might be passed through the tarpaulin 4 or the other wall 14 or might be adhesively bonded or sewed with the tarpaulin 4 or wall 14. The check valves 10 might be build by check valve flaps, e.g. made of a textile or polymeric material. Also any other type of per se known check valves might be used.

In case that a fire builds up within the container 1 and the temperature exceeds the threshold temperature for triggering the shrinkage process of the thermoplastic material, there is no additional manual action required for automatically reorienting the thermoplastic material in the support structure, in particular the tent poles 3 or the deformation elements 5. This leads to a shrinkage or gathering of the wall 14 with a reduction of the volume of the interior space 7. The thermoplastic material is chosen to be both mechanically resistant as well as heat resistant. The threshold value of the shrinkage temperature of the chosen thermoplastic material is such that this threshold temperature is slightly above the temperature of the container 1 during its normal use without any fire.

The inventive container 1 might be free of maintenance. Due to the plurality of possible deformation elements 5 or thermoplastic threads a damage of wall 14 in some cases only has a small effect of the ability to extinguish a fire.

According to FIG. 5 an adhesive layer 17 is used. With increasing temperature, i.e. a temperature in the region of the threshold value for the shrinkage temperature of the deformation elements 5, the adhesive force is reduced.

The wall 14, in particular the tarpaulin 4, might be very thin so that a container 1 results having a small weight. In case of using the add-on kit 13, only a small additional weight results when compared to the common container 12. Any additional weight required by the invention might be saved at another place by saving additional means for extinguishing a fire, e.g. fire extinguishers in the cargo space of the airplane.

For the tent-like design of the container 1 according to FIGS. 1 and 2 as well as for the add-on kit 13 according to FIGS. 3 to 5 the wall 14 might comprise openings for loading and unloading the container 1. The opening might be built with zip fasteners, hook-and-loop tapes or other connections flexible with respect to their shape, wherein it is possible to close the openings impermeable for air or fluid or at least a reduced permeability for air.

Many variations and modifications may be made to the preferred embodiments of the invention without departing substantially from the spirit and principles of the invention. All such modifications and variations are intended to be included herein within the scope of the present invention, as defined by the following claims.

We claim:

1. A container comprising:

a) a wall limiting an interior space, said interior space being sealed against an exterior for avoiding an entry of fluid, b) said wall having ba) a first operating configuration wherein said interior space limited by said wall has a first volume $V_{I1}$, and bb) a second operating configuration wherein said interior space limited by said wall has a second volume $V_{I2}$ being smaller than said first volume $V_{I1}$, c) a check valve blocking fluid from streaming from the exterior into said interior space but opening for a stream of fluid from said interior space to the exterior, and d) an actuation means designed and configured for automatically transferring said wall from said first operating configuration into said second operating configuration in case of a fire e) wherein with the transfer of said wall from said first operating configuration into said second operating configuration a fluid contained in said interior space is pushed from said interior space via said check valve to the exterior f) wherein the container is designed and configured for being used as a cargo container.

2. The container of claim 1, wherein:

a) said wall limiting said interior space is built by a flexible non-rigid material, b) a holding device is provided for holding said wall in said first operating configuration, and c) said actuation means deactivates said holding device in case of a fire for triggering the automatic transfer of said wall into said second operating configuration.

3. The container of claim 2, wherein said holding device is built with an elastic deformation element wherein an elastic pretension of said elastic deformation element is larger in said first operating configuration of said wall than in said second operating configuration of said wall and wherein by a relaxation of said elastic deformation element fluid is pushed from said interior space via said check valve to the exterior.

4. The container of claim 3, wherein at least one of a plurality of strains or one of a plurality of stresses caused by stretching during the manufacturing process is frozen in said holding device by cooling down the holding device in its stretched state, and said plurality of strains or said plurality of stresses are freed by an increase of the temperature in said interior space due to a fire.

5. The container of claim 4, wherein said material of said wall is built by a textile material or polymeric material having a low flammability or which is non-flammable.

6. The container of claim 2, wherein said wall is transferred by its weight from said first operating configuration into said second operating configuration.

7. The container of claim 2, wherein said interior space is limited by a tarpaulin which is spanned by a holding device built by tent poles for limiting said interior space with the first volume $V_{I1}$ in said first operating configuration.

8. The container of claim 2, wherein at least one of a plurality of strains or one of a plurality of stresses caused by stretching during the manufacturing process is frozen in said holding device by cooling down the holding device in its stretched state, and said plurality of strains or said plurality of stresses are freed by an increase of temperature in said interior space due to a fire.

9. The container of claim 8, wherein said wall is built with a textile material or polymeric material having a low flammability or which is non-flammable.

10. The container of claim 2, wherein said wall is built with a textile material or polymeric material having a low flammability or which is non-flammable.

11. The container of claim 1, wherein said wall is built with a textile material or polymeric material having a low flammability or which is non-flammable.

12. The container of claim 1, wherein said wall comprises openings with sealed closing elements.

* * * * *